US005975666A

United States Patent [19]

Kawaguchi

[11] Patent Number: 5,975,666

[45] **Date of Patent: *Nov. 2, 1999**

[54] INK JET RECORDING APPARATUS WITH GAP ADJUSTMENT BETWEEN RECORDING HEAD AND RECORDING MEDIUM

[75] Inventor: Koichiro Kawaguchi, Yokohama, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/922,556

[22] Filed: Sep. 3, 1997

Related U.S. Application Data

[63] Continuation of application No. 08/795,726, Feb. 4, 1997, abandoned, which is a continuation of application No. 08/298,329, Aug. 30, 1994, abandoned.

[30] Foreign Application Priority Data

Sep. 1, 1993 [JP] Japan ..... 5-217267
Aug. 26, 1994 [JP] Japan ..... 6-202135

[51] Int. Cl.[6] ..... B41J 25/308; B41J 2/01

[52] U.S. Cl. ..... 347/8; 400/59

[58] Field of Search ..... 347/8, 14; 400/56, 400/57, 58, 59

[56] References Cited

U.S. PATENT DOCUMENTS 4,927,277 5/1990 Niikawa ..... 347/8
5,187,497 2/1993 Hirano et al. ..... 400/59
5,366,301 11/1994 Martin et al. ..... 347/8
5,398,049 3/1995 Terasawa et al. ..... 347/8
5,610,636 3/1997 Hanabusa et al. ..... 347/8

*Primary Examiner*—N. Le
*Assistant Examiner*—L. Anderson
*Attorney, Agent, or Firm*—Fitzpatrick, Cella Harper & Scinto

[57] ABSTRACT

An ink jet recording apparatus, which performs recording onto a recording medium using an ink jet recording head, includes a conveying device for conveying the recording medium to the ink jet recording head, a supporting device for oscillatably supporting the ink jet recording head in a direction away from the recording medium, the supporting device having an oscillating central shaft extending along a direction transverse to a conveying direction of the recording medium, a position detector for detecting the position on a conveying passage of the recording medium conveyed by the conveying device, a paper gap adjusting device for adjusting the distance between the recording medium conveyed by the conveying device and the recording head, a setting device for setting the amount of conveying the recording medium from the position detected by the position detector in accordance with the distance between the recording medium and the recording head which is adjusted by the paper gap adjusting device, and a controller for controlling the conveying device to convey the recording medium by the conveying amount set by the setting device.

48 Claims, 10 Drawing Sheets

INK JET RECORDING APPARATUS WITH GAP ADJUSTMENT BETWEEN RECORDING HEAD AND RECORDING MEDIUM

This application is a continuation of application Ser. No. 08/795,726 filed Feb. 4, 1997, now abandoned, which is a continuation of application Ser. No. 08/298,329 filed Aug. 30, 1994, abandoned.

BACKGROUND OF THE INVENTION

1. Field of the Invention

The present invention relates to an ink jet recording apparatus, and more particularly to an ink jet recording apparatus having a paper gap adjusting mechanism for adjusting the distance between a recording head and a platen, corresponding to the kind of recording medium or the recording pattern.

2. Related Background Art

Conventionally, recording apparatuses have been provided with a paper gap adjusting mechanism for adjusting the gap between a recording head and a recording sheet to enable the recording of invariable quality for recording sheets having different thicknesses.

FIG. 1 is a side view showing a constitutional example of a recording unit for an ink jet recording apparatus as an example which has a paper gap adjusting mechanism for adjusting the gap between the recording sheet and the ink jet recording head by rotating the head.

A sheet 11 supplied from a sheet supply tray 15 by the operation of a sheet supply roller 13 and a separation pad 14 is detected by a sheet top detection lever 8, and then conveyed a fixed amount to come under the recording head 4.

A carriage shaft 3 and a pinch roller base 12 are supported by left and right plates, not shown, in the apparatus, a carriage 2 being engaged freely rotatably around the carriage shaft 3 via a carriage bearing 2D.

The paper gap adjusting lever 1 is rotatably attached to the carriage 2 via a shaft 1A. A stepped cam 1B attached near an engagement portion of the paper gap adjusting lever 1 around the shaft 1A is pressed against the pinch roller base 12 by the dead weight of the carriage 2 and the paper gap adjusting lever 1. A projection 1C provided near a halfway point of the lever 1 can be engaged into any of three concave portions formed on a side face of the carriage 2 by the rotation of the lever 1, thereby occupying one of a first position 2A, a second position 2B and a third position 2C of the lever 1. With the above position of this lever 1 varied, a respective one of the faces of the stepped cam 1B which have different heights abuts on the pinch roller base 12, whereby the distance between an orifice face of the head 4 secured to the carriage 2 and the platen can be changed in three ways.

The carriage 2 is reciprocated in the sheet width direction along the carriage shaft 3 and the pinch roller base 12, to make the recording onto the recording sheet 11 by discharging the ink from the recording head 4, along with the movement of the carriage 2. A pinch roller 7 is biased by a spring, thereby forcing the recording sheet 11 onto a conveying roller 6.

FIGS. 2 to 4 are side views showing the paper gap distance when the paper gap adjusting lever 1 is placed at the first, second and third positions, respectively. As will be clear from the views, the paper gap distance increases in the order of the first, second and third positions, such as 1.2 mm, 1.7 mm and 2.2 mm.

Reference is further made to FIG. 5. By rotating or turning the recording head in a Y direction around a virtual rotational center 3A of the recording head 4, the paper gap distance between the recording sheet 11 and the recording head 4 can be adjusted. In this regard, if the paper gap distance is varied from h1 to h2 by turning the recording head 4, ink droplets discharged from the ink jet recording head 4 onto the recording sheet 11 occur in f1 and f2 directions to impinge at $\mathbf{1}_1$ and $\mathbf{1}_2$, respectively. Note that the Z direction is a conveying direction of the recording sheet 11.

However, in the conventional example as above described, the search position of the head of the recording sheet, that is, the conveying amount x (see FIGS. 2 to 4 and when the recording sheets 11 are conveyed in a rightwise direction in FIG. 5) after the top of the sheet is detected by the sheet top detection lever 8 is always constant, irrespective of the distance between the recording head and the platen (paper gap distance). Therefore, there was a problem that if the paper gap adjustment is made corresponding to the kind of the recording sheet or the recording pattern, the start position of recording, that is, the position at which the ink is first discharged from the recording head 4 onto the top portion of the recording sheet 1, may be different depending on the paper gap distance, such as 3.5 mm, 3.1 mm and 2.8 mm, as shown in FIGS. 2 to 4. That is, there was a problem that an offset Δ1 of the ink impinging or reaching position may occur as shown in FIG. 5.

Also, when the adjusting width of the paper gap distance according to the position of the lever 1 is greater, e.g., when the lever 1 is shifted to the third position, there is the possibility that as the top of the recording sheet 11 does not already arrive to the discharge position of the recording head 4, the recording may occur outside of the recording sheet. If the attempt is made to prevent this, there was a problem that the margin at the top of the sheet is excessively large in recording at the first position, resulting in the recordable range being narrowed.

Also, in an arrangement that the ink discharge orifices are disposed ahead of the rotation center of the recording head in the conveying direction of the recording sheet 11 and that the recording sheet 11 is conveyed in a leftwise direction in FIG. 5, if the paper gap distance is large, there was a problem that the ink may impinge beyond the end of the sheet.

Furthermore, the above problems may likewise arise in the constitution in which the recording head 4 is oscillated around the center of oscillation with respect to the recording sheet 11.

SUMMARY OF THE INVENTION

The present invention has been achieved to resolve the aforementioned conventional problems, and its objective is to provide an ink jet recording apparatus which can perform the recording on a predetermined area of the recording sheet at all times without change of the recording start position on the recording sheet if the paper gap distance is varied.

It is another object of the present invention to provide an ink jet recording apparatus which controls the conveying amount of the recording medium from a predetermined position on the conveying passage in accordance with the distance between the recording head and the recording medium to prevent the position of the recording medium on the conveying passage with respect to the recording head from changing, even if the distance between the recording head and the recording medium is varied, thereby maintaining invariable, for example, the recording start position on the recording medium, at all times.

It is a further object of the present invention to provide an ink jet recording apparatus which can change the amount of searching the head of the recording sheet which is supplied in accordance with the distance between the recording head and the platen, and make the recording start position on the recording sheet invariable at all times, even if the paper gap distance is varied depending on the kind of the recording sheet or the recording pattern, thereby assuring the wide recordable range without causing any conventional well-known problem that the margin at the top of the sheet must be reserved unnecessarily widely to avoid the recording outside of the sheet.

It is a still further object of the present invention to provide an ink jet recording apparatus which can make the automatic adjustment of the amount of searching the head of the sheet which is supplied in accordance with the distance between the recording head and the platen in cooperation with a paper gap adjusting mechanism and is easy to use.

It is another object of the present invention to provide an ink jet recording apparatus which performs the recording onto the recording medium using an ink jet recording head, comprising, conveying means for conveying the recording medium to said ink jet recording head, supporting means for oscillatably supporting said ink jet recording head in a direction away from said recording medium, said supporting means having an oscillating central shaft extending along a direction crosswise to a conveying direction of said recording medium, position detecting means for detecting the position on a conveying passage of the recording medium conveyed by said conveying means, paper gap adjusting means for adjusting the distance between the recording medium conveyed by said conveying means and said recording head, setting means for setting the amount of conveying said recording medium from the position detected by said position detecting means in accordance with the distance between the recording medium and said recording head which is adjusted by said paper gap adjusting means, and control means for controlling said conveying means to convey the recording medium by the conveying amount set by said setting means.

DETAILED DESCRIPTION OF THE PREFERRED EMBODIMENTS

The preferred embodiments of the present invention will be described in detail with reference to the drawings.

Figure 1:
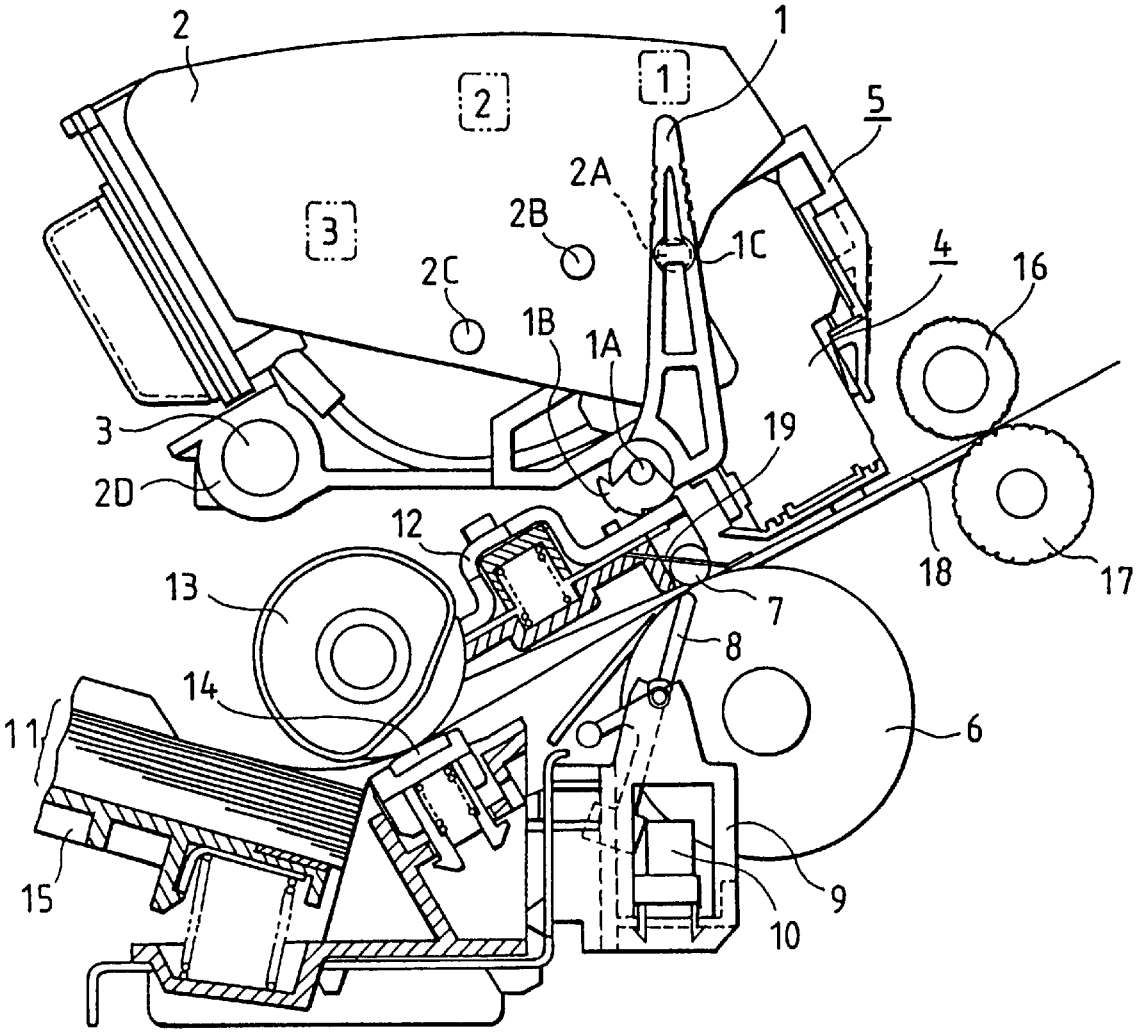
FIG. 1 PRIOR ART
FIG. 1 is a typical side view showing a constitutional example of a recording unit of a conventional ink jet recording apparatus.
Figure 2:
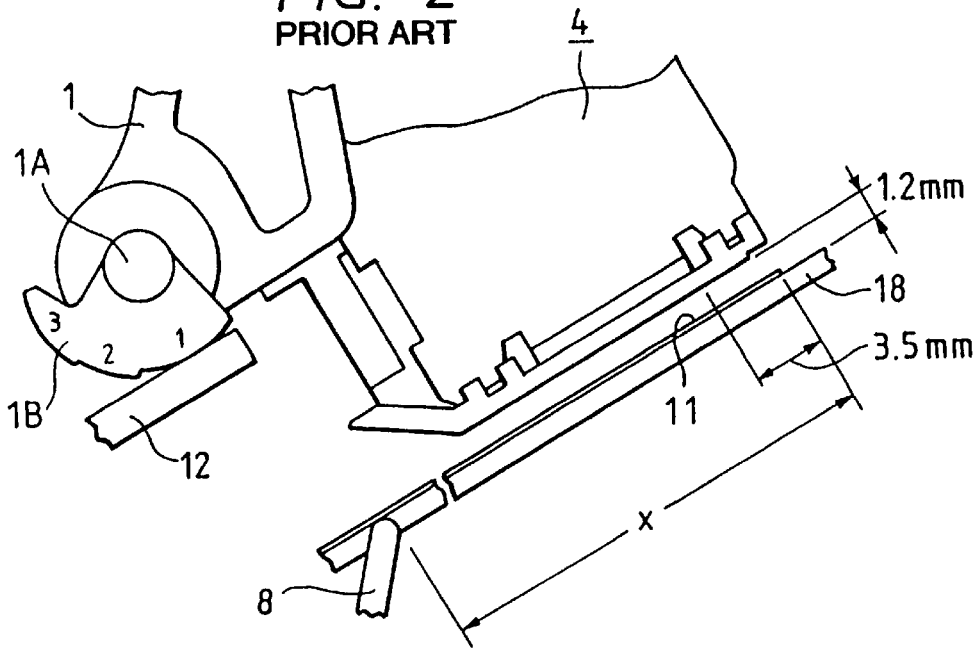
FIG. 2 PRIOR ART
FIG. 2 is an explanatory view for explaining a problem that the recording start position on the recording sheet may change depending on the distance between the recording head and the recording sheet.
Figure 3:
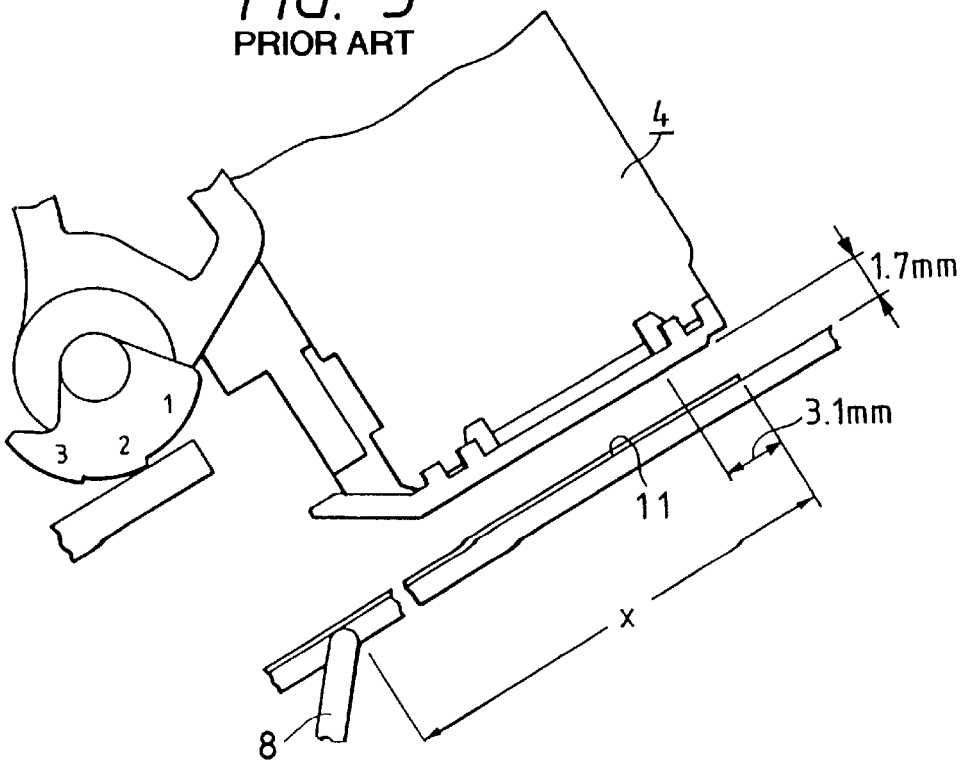
FIG. 3 PRIOR ART
FIG. 3 is an explanatory view for explaining the problem that the recording start position on the recording sheet may change depending on the distance between the recording head and the recording sheet.

A recording unit of a recording apparatus according to one embodiment of the present invention can be the same as that shown in FIG. 1. Referring again to FIG. 1 herein, its mechanism will be described in more detail.

It should be noted that the embodiment as detailed below has an arrangement having the center of rotation (oscillation) and the recording position disposed in order in a conveying direction of the recording sheet (which may be any kind of the recording medium as the sheet-like member recordable with the ink such as a plastic thin plate, a cloth and so on). However, it is likewise applicable to the purpose for properly detecting the bottom of the sheet with an arrangement having the recording position and the center of rotation (rocking movement) disposed in order in the conveying direction.

In FIG. 1, 15 is a sheet supply tray, and 11 is a stack of recording sheets thereon. 13 is a sheet supply roller for supplying the recording sheet to the recording unit, and 14 is a separation pad having a friction piece for preventing more than one sheet 11 from being fed to the recording unit. 8 is a sheet top detection lever rotatably attached to a sensor base 9, and 10 is a photo-sensor for sensing the rotational movement of the detection lever 8. 6 is a conveying roller for conveying the recording sheet 11, 7 is a pinch roller which is biased toward the conveying roller 8 by a spring, 19 is a sheet presser spring for preventing the recording sheet 11 from floating from the platen 18, 17 is a sheet exhausting roller, and 16 is a spur which is biased toward the sheet exhausting roller 17 by a spring.

2 is a carriage which is engaged around a carriage shaft 3 via a carriage bearing 2D, the shaft 3 being secured by left and right plates, not shown, of the apparatus main body. 4 is a recording head, which is secured to the carriage 2 by a head cover 5. The recording head 4 is of a conventional ink jet type that includes electrothermal transducers to generate heat energy in ink to create bubbles to displace and discharge ink droplets. 1 is a paper gap adjusting lever, as above described, which is rotatably attached via a lever shaft 1A to the carriage 2. At one end of the lever 1, a stepped cam 1B disposed around the lever shaft 1A is provided.

The stepped cam 1B abuts on the pinch roller base 12 secured by the left and right plates of the apparatus main body. A lever projection 1C provided on the lever 1 can be engaged into a concave portion provided on a side face of the carriage at each of the first position 2A, the second position 2B and the third position 2C, as above described. The abutting face of the stepped cam 1B on the pinch roller base 12 may vary corresponding to each of these positions, whereby the carriage 2 is rotated around the carriage shaft 3 so that the distance between the recording head 4 and the sheet 11 can be changed at three stages.

Figure 6:
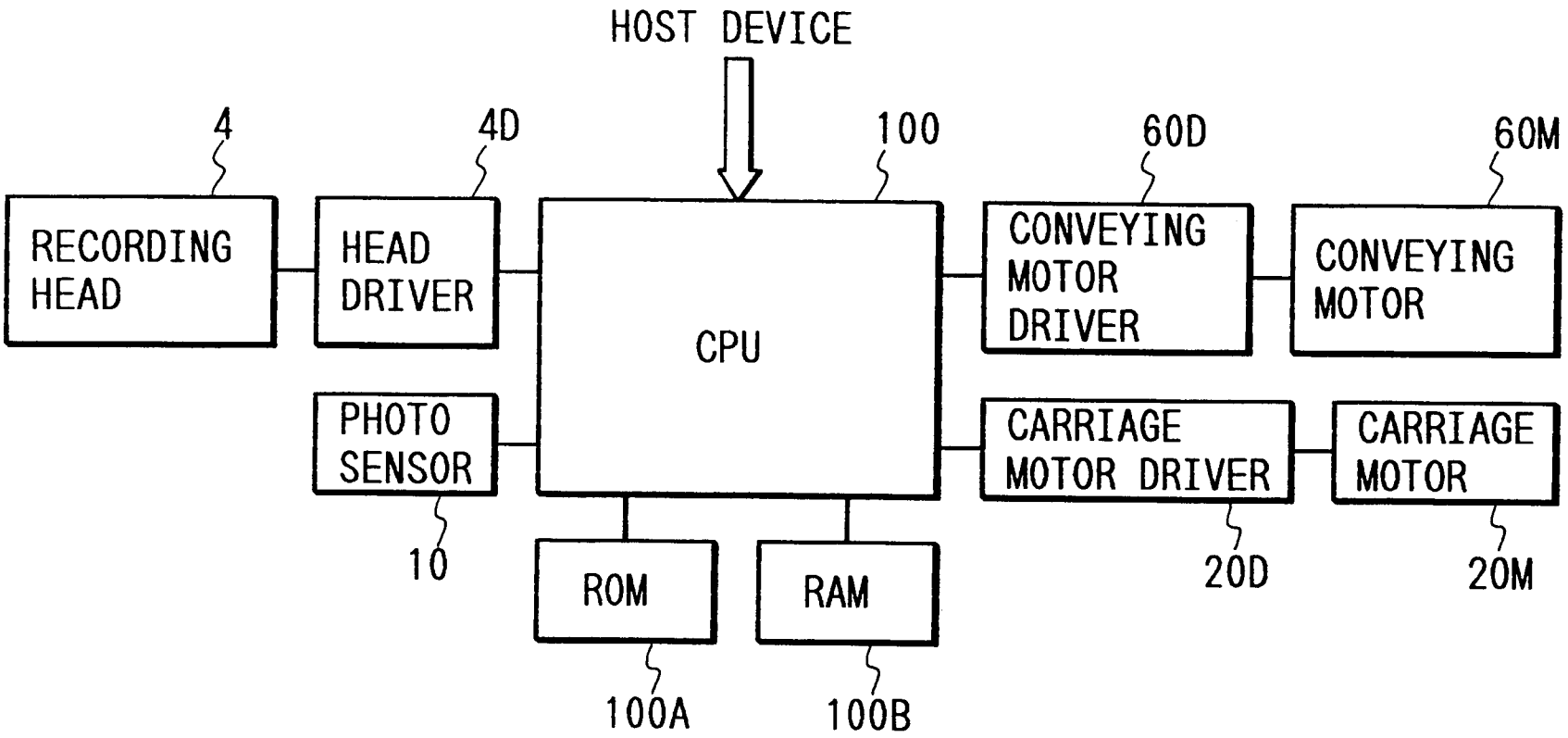
FIG. 6 is a block diagram showing a control configuration of a recording apparatus according to an embodiment of the present invention.

FIG. 6 is a block diagram showing a control configuration of the recording apparatus according to one embodiment of the present invention.

A CPU 100 performs the control of each unit in the apparatus of this embodiment or the processing of data in accordance with the processing procedure stored in a ROM 100A. A conveying motor 60M is a motor for driving the conveying roller 6, the sheet supply roller 13 and the sheet exhausting roller 17 as shown in FIG. 1, the rotation thereof being controlled via a motor driver 60D. Likewise, a carriage motor 20M is a motor for moving the carriage 2, and is controlled via a motor driver 20D. The ink discharge from the recording head is controlled via a head driver based on the recording data sent from a host device. Also, the sensed output of the photo-sensor 10 is sent to the CPU 100.

Figure 4:
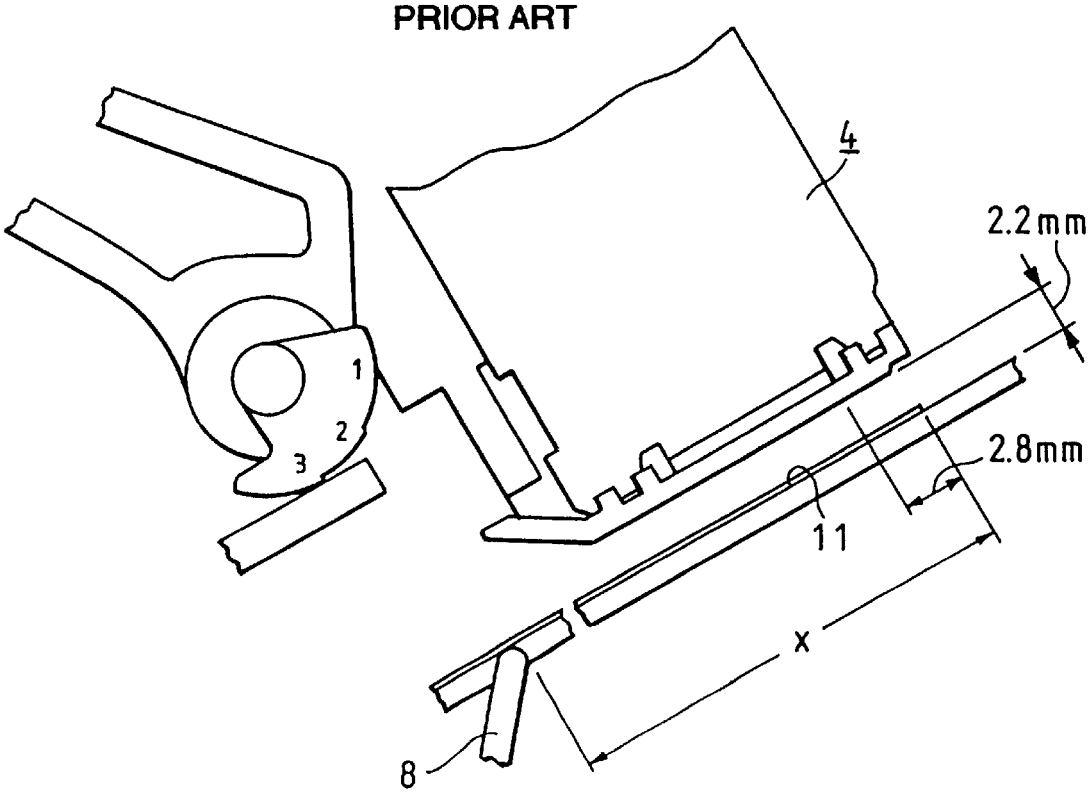
FIG. 4 PRIOR ART
FIG. 4 is an explanatory view for explaining the problem that the recording start position on the recording sheet may change depending on the distance between the recording head and the recording sheet.

In the above constitution as shown in FIGS. 1 and 4, the sheet supply tray 15 is lifted upon a sheet supply signal, while the sheet supply roller 13 is rotated to supply an uppermost recording sheet on the tray 15 to the recording unit. If more than one sheet is supplied, the separation pad 14 acts to supply only one sheet to the recording unit.

If the top of the sheet 11 arrives at the top detection lever 8, the lever 8 is forced by the sheet 11 to rotate in a right direction in FIG. 1, so that the optical path of the photo-sensor 10 is opened. Thereby, the top of the sheet can be sensed.

After being sensed, the sheet 11 is further conveyed under the recording head 4 by the conveying roller 6, in which the amount of conveying the sheet after sensing the top of the sheet can be changed in accordance with the position of the paper gap adjusting lever 1.

Figure 7:
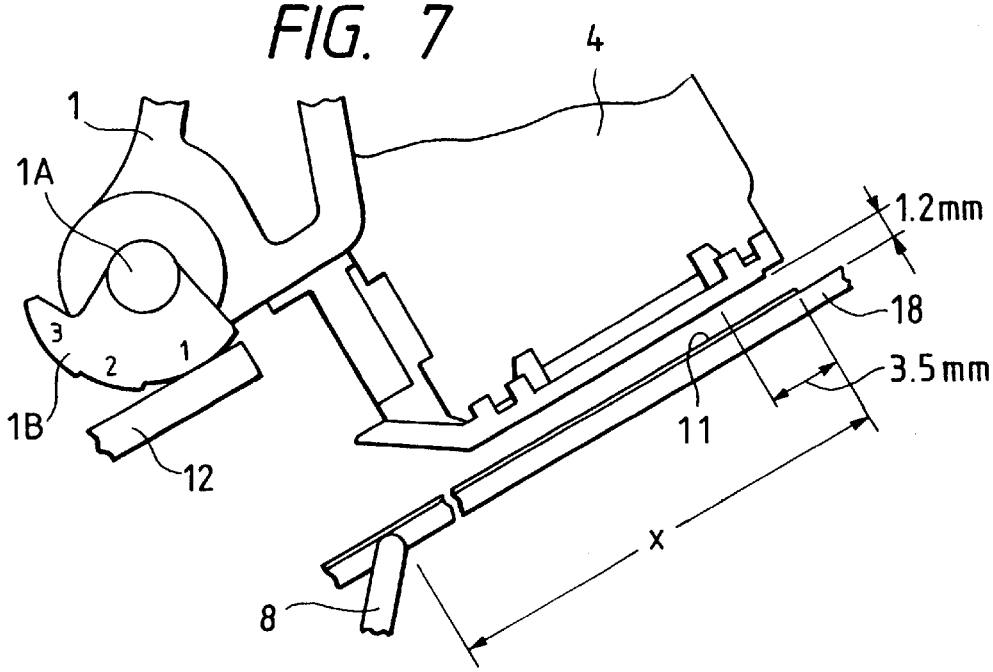
FIG. 7 is an explanatory view for explaining how to maintain the recording start position on the recording sheet invariable at all times by controlling the conveying amount in accordance with the distance between the recording head and the recording sheet, according to one embodiment of the present invention.
Figure 8:
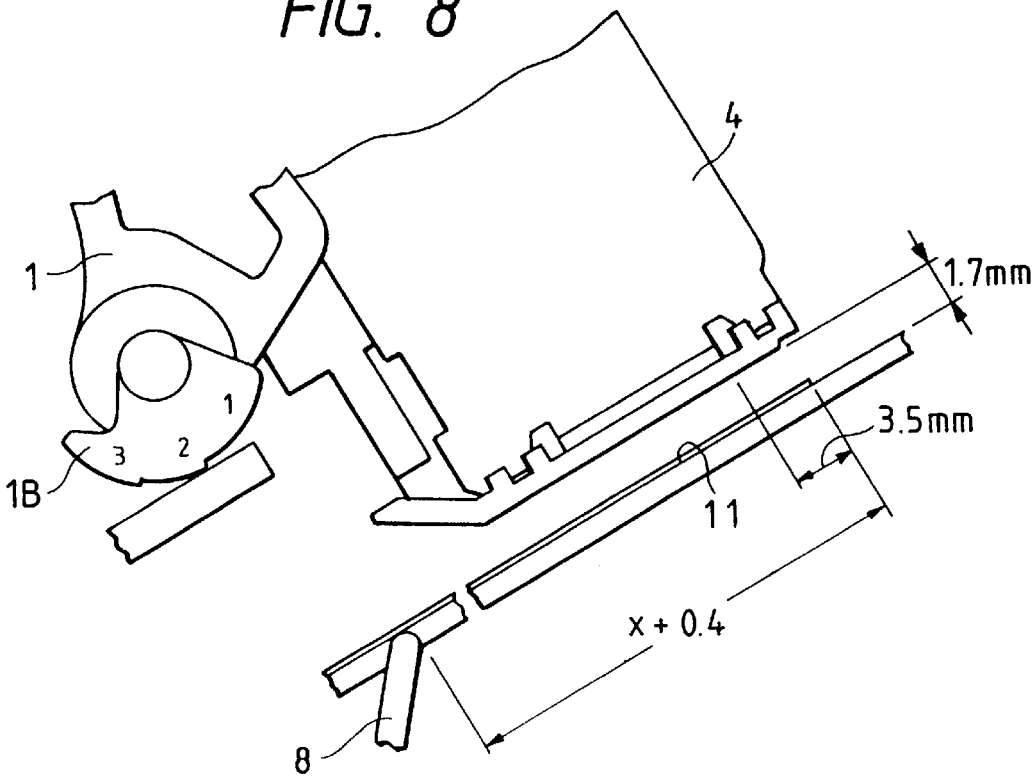
FIG. 8 is an explanatory view for explaining how to maintain the recording start position on the recording sheet invariable at all times by controlling the conveying amount in accordance with the distance between the recording head and the recording sheet, according to one embodiment of the present invention.
Figure 9:
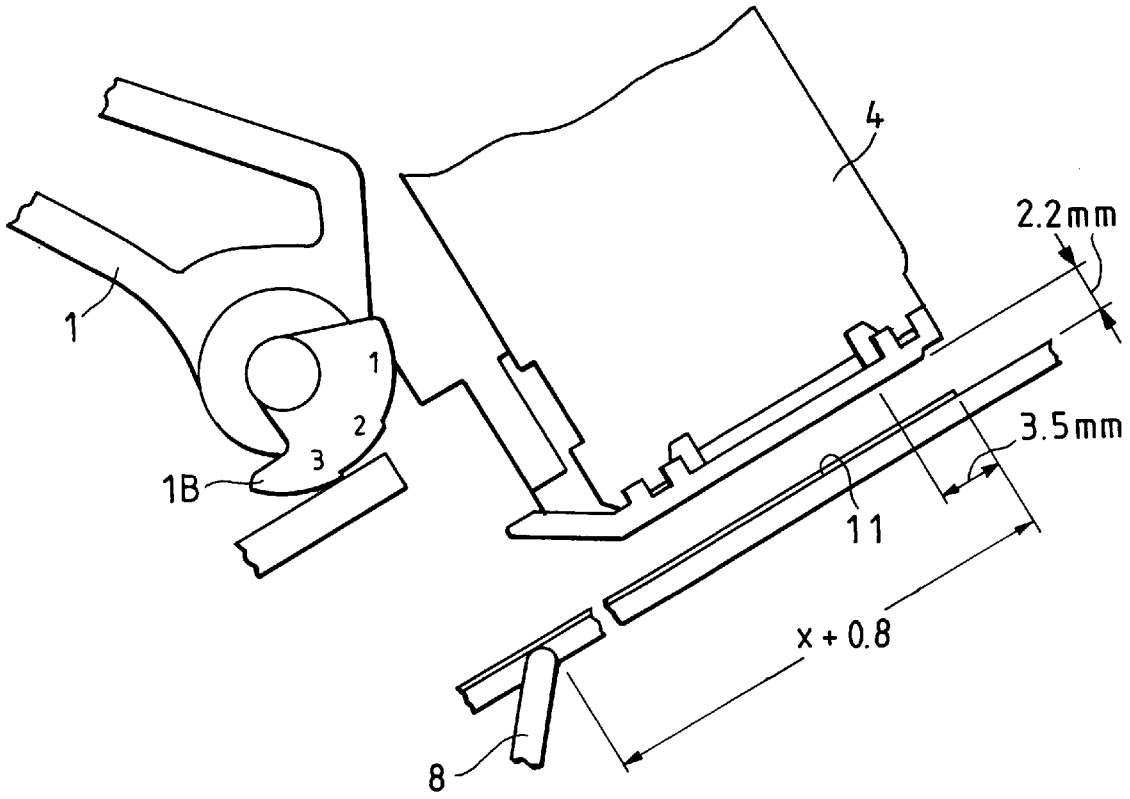
FIG. 9 is an explanatory view for explaining how to maintain the recording start position on the recording sheet invariable at all times by controlling the conveying amount in accordance with the distance between the recording head and the recording sheet, according to one embodiment of the present invention.

That is, supposing that when the paper gap adjusting lever 1 is at the first position 2A as shown in FIG. 7, the conveying amount from sensing the top of the sheet by the lever 8 to starting the recording is a reference amount x, the conveying amount after sensing is set to (x+0.4) at the second position of the paper gap adjusting lever 1 as shown in FIG. 8, and it is greater, or set to (x+0.8) at the third position, as shown in FIG. 9.

This change of the conveying amount can be made by the selection from an operation panel, not shown, corresponding to the position of the paper gap adjusting lever 1, i.e., the distance between the recording head and the platen.

In the case where the operator selects on the operation panel a different conveying amount from that of the recording sheet 11 corresponding to the position of the paper gap adjusting lever 1, it is preferable that the false selection is displayed or the warning is issued, or the conveyance of the sheet 11 is prohibited.

As above described, by changing the amount of searching the head of the recording sheet supplied corresponding to the position of the paper gap adjusting lever 1, i.e., the distance between the recording head and the platen, the recording start position on the recording sheet can be made invariable at all times, even if the paper gap distance is varied in accordance with the kind of the sheet or the recording pattern. Also, thereby, there is no conventional well-known problem that the margin at the top of the sheet is reserved unnecessarily broadly to avoid recording out of the sheet, so that the recordable range can be retained widely.

Figure 10:
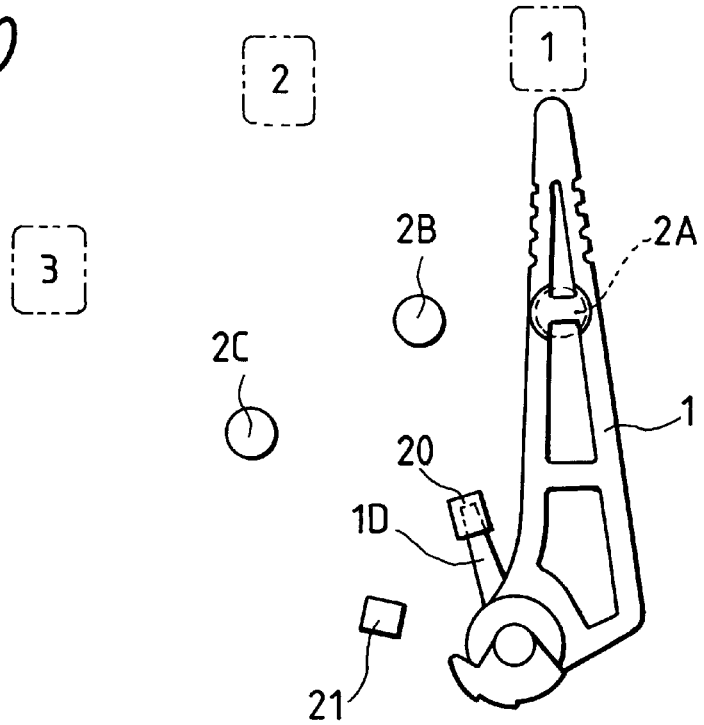
FIG. 10 is an explanatory view for explaining a mechanism for detecting the position of a paper gap adjusting lever for setting the distance between the recording head and the recording sheet, according to another embodiment of the present invention.
Figure 11:
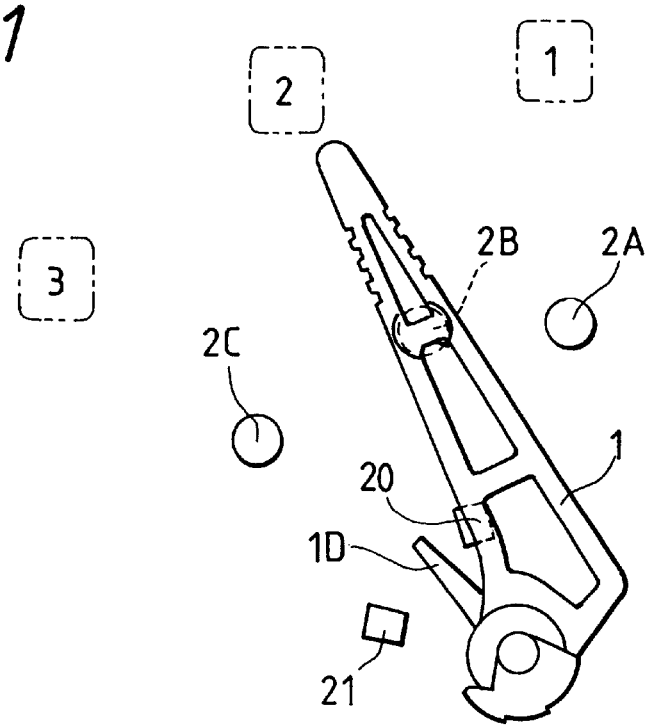
FIG. 11 is an explanatory view for explaining a mechanism for detecting the position of the paper gap adjusting lever for setting the distance between the recording head and the recording sheet, according to another embodiment of the present invention.
Figure 12:
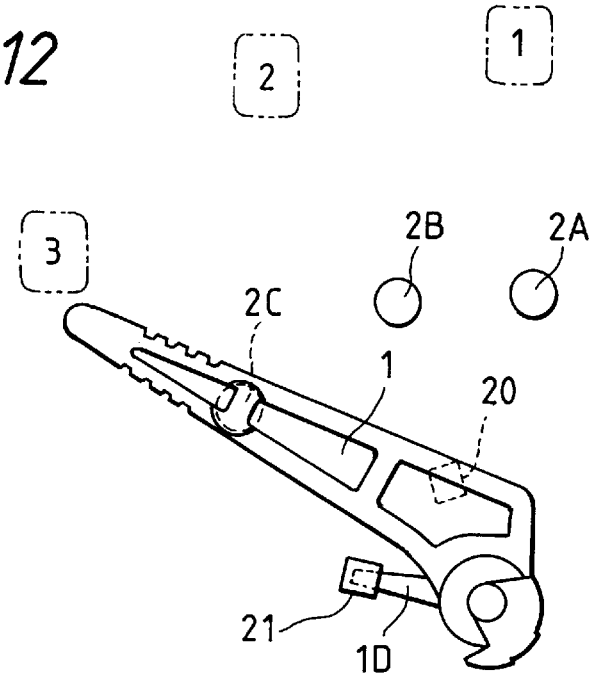
FIG. 12 is an explanatory view for explaining a mechanism for detecting the position of the paper gap adjusting lever for setting the distance between the recording head and the recording sheet, according to another embodiment of the present invention.

FIGS. 10 to 12 show another embodiment wherein the setting of the conveying amount in accordance with the position of the paper gap adjusting lever is automatically performed, but not by the user via the operation panel as in the above embodiment. Other constitution is the same as the ink jet recording apparatus as above described.

As shown in FIG. 10, when the paper gap adjusting lever 1 is at the first position 2A, a sensor interrupting portion 1D provided on the paper gap adjusting lever 1 will interrupt a photo-sensor 20 alone. Also, when the paper gap adjusting lever 1 is at the second position, it will not interrupt any of the photo-sensors 20, 21 as shown in FIG. 11. Further, when the paper gap adjusting lever 1 is at the third position, it will interrupt a photo-sensor 21 alone as shown in FIG. 12.

Table 1 shows the combination of outputs from the sensors 20, 21 in accordance with each position of the paper gap adjusting lever 1. The CPU 100 determines the predetermined amount of searching the head from a correspondence table between the sensor output and the amount of searching the head which is preinput into the ROM 100A based on the combination of outputs from the sensor.

TABLE 1

| Paper gap adjusting lever position | Sensor 20 | Sensor 21 |
|---|---|---|
| First position (2A) | X | O |
| Second position (2B) | O | O |
| Third position (2C) | O | X |

O . . . Detected (non-interrupted)
X . . . Not detected (interrupted)

In this way, by detecting the position of the paper gap adjusting lever based on the combination of outputs from the photo-sensors 20, 21, the optimal amount of searching the head of the recording sheet can be automatically set corresponding to the paper gap distance at that time.

Thereby, the optimal conveyance (head search) of the recording sheet can be attained by the operator only operating the paper gap adjusting lever 1.

Figure 5:
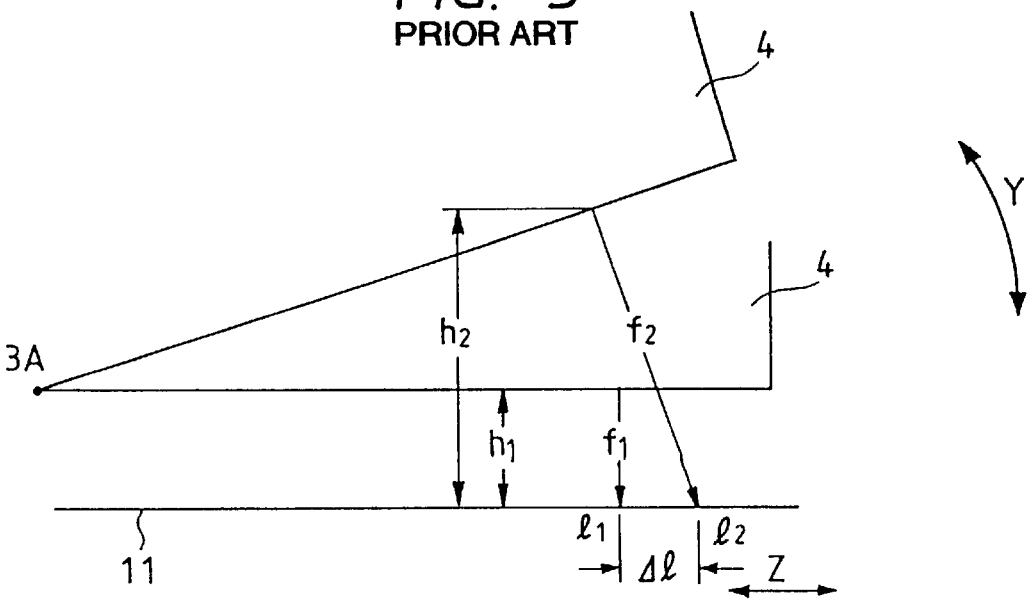
FIG. 5 PRIOR ART
FIG. 5 is an explanatory view for explaining the problem that the recording start position on the recording sheet may change depending on the distance between the recording head and the recording sheet.

In FIG. 5, Δ1 can be obtained geometrically as a function of the paper gap distance h and the rotation angle θ. Thus, a further embodiment will be presented below in which the paper gap adjusting position can be selected at non-stage, instead of at three paper gap adjusting positions as above described, that is, the paper gap distance can be selected at non-stage within a certain scope.

Figure 13:
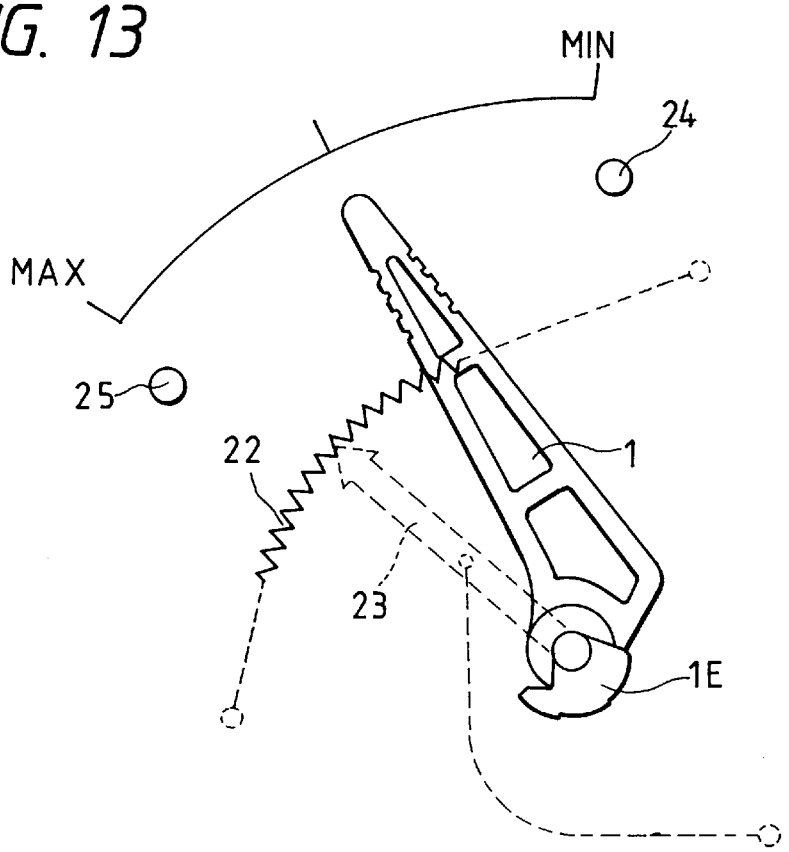
FIG. 13 is an explanatory view for explaining a mechanism for detecting the position of the paper gap adjusting lever for setting the distance between the recording head and the recording sheet, according to still another embodiment of the present invention.

FIG. 13 shows an example in which when the paper gap adjustment can be effected at non-stage, the appropriate conveying amount can be automatically selected, linked with the operation of it.

In this figure, the paper gap adjusting lever 1 is settable at non-stage between the stoppers 24, 25, the paper gap being set corresponding to the position of the paper gap adjusting lever 1 by a cam 1E.

Since a slider 23 which is an electrical contact is linked with the paper gap adjusting lever 1, the contact position of the slider 23 with a resistor 22 may vary along with the position of the paper gap adjusting lever 1.

The resistance will vary with this change of the contact position, so that the output current value will also vary, whereby the position of the paper gap adjusting lever 1 can be detected by reading the current value.

And with the position of the paper gap adjusting lever, the CPU 100 can determine the optimal head search amount from Δ1 which is calculated based on the paper gap distance h and the rotation angle θ at that time 1.

In this way, by using a variable resistor in this embodiment, the position of the paper gap adjusting lever 1 can be detected at non-stage, and correspondingly, the amount of searching the head of the recording sheet can be automatically changed at non-stage. Also, position detecting means of the paper gap adjusting lever is not necessarily limited to the variable resistor, but may be implemented with an encoder, for example, to the same effect.

Figure 14:
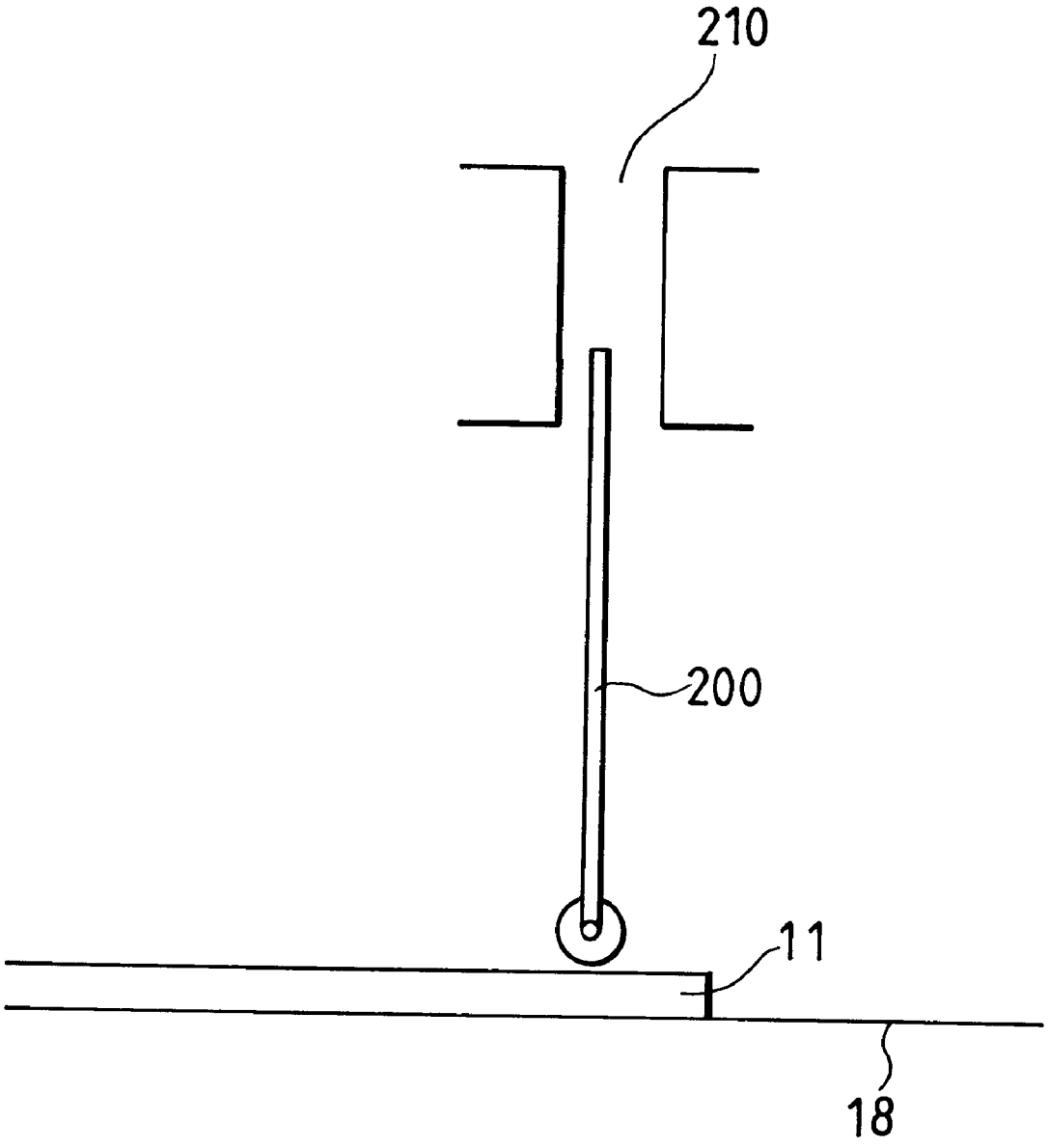
FIG. 14 is an explanatory view for explaining a mechanism for detecting the paper thickness of the recording sheet.

FIG. 14 is an explanatory view for a constitution of measuring the paper thickness in an embodiment in which the apparatus itself automatically measures the paper thickness without the operation of the paper gap adjusting lever by the operator, and performs the optimal paper gap distance and the searching of the sheet head in accordance with its paper thickness.

There is provided a device 210 for detecting the vertical movement amount of a detection rod 200 which is movable vertically depending on the paper thickness as the variation of electrostatic capacity. The CPU 100 rotates or oscillates the recording head using driving means, not shown, to obtain the paper gap distance in accordance with the paper thickness based on the information from the device 210, as well as searching the head of the recording sheet in accordance with the paper gap distance by the action of the above-described mechanism.

As above detailed, the search of the head of paper gap distance between the recording head which is rotating or oscillating and the recording sheet can be accomplished.

In this embodiment, it is desirable that the registration of the recording sheet has been done in recording. By registration is meant the alignment of the top of the recording sheet in a direction orthogonal to the conveying direction of the recording sheet. When the search of head is performed in such a way as to convey the sheet a predetermined amount after detecting the top of the recording sheet with the paper detection sensor 8, the amount of searching the head is difficult to be constant because of the accuracy in detecting the top of the sheet, the floating of the sheet, or the skewed conveyance of the sheet.

Figure 15A:
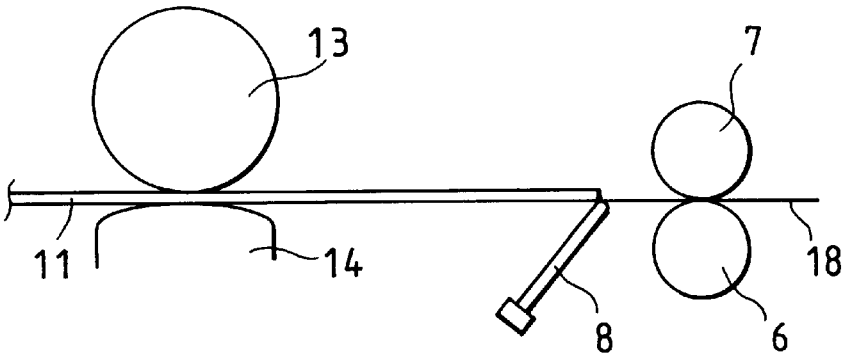
FIGS. 15A, 15B and 15C are explanatory views for explaining a mechanism for correcting the top of the recording sheet to be directed orthogonal to its conveying direction.
Figure 15B:
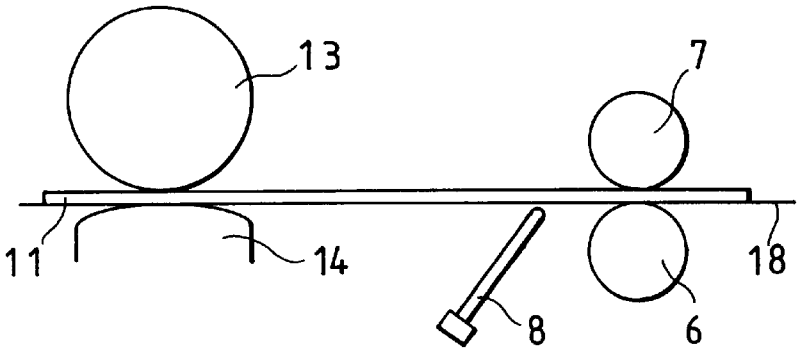
Figure 15C:
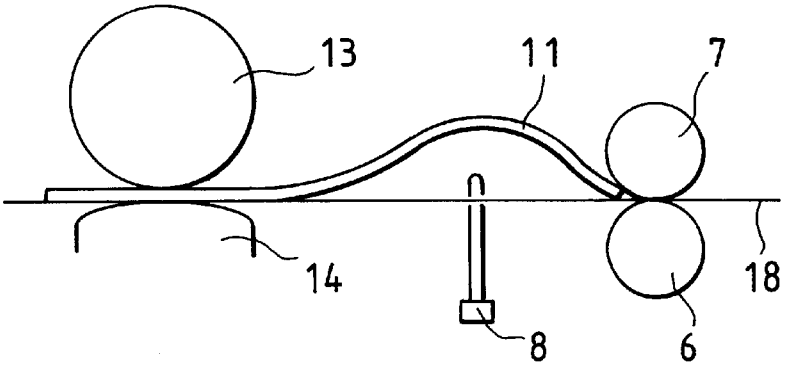

Referring now to FIGS. 15A to 15C, a preferred constitution of searching the head of the recording sheet will be described. After the top of the recording sheet 11 is detected by the paper detection sensor 8 (FIG. 15A), a pair of rollers 6, 7 are forwardly rotated a fixed amount to convey the recording sheet ahead of the pair of rollers 6, 7 (FIG. 15B). Then, the pair of rollers 6, 7 are reversely rotated to convey the top of the recording sheet in an opposite direction while the roller 13 is rested to hold immovably the bottom of the recording sheet therebetween. And after the top forms a loop by reversely rotating the pair of rollers 6, 7 by a a predetermined amount (FIG. 15C), the pair of rollers 6, 7 are forwardly rotated to convey the recording sheet to a recording area where the recording head is provided. By doing so, the top of the recording sheet can be aligned in the direction orthogonal to the conveying direction of the recording sheet, thereby allowing for the correct search of the head.

In the above embodiment, the recording head is moved away from the recording sheet by rotation, but it will be appreciated that the recording head may be moved away from the recording sheet while oscillating, so that the recording position on the recording sheet may be changed in a predetermined way, to which the present invention is also effectively applicable.

Also, in the above embodiment, the recording head is serially moved, carried on the carriage, but it will be appreciated that the present invention is effectively applicable to a recording apparatus comprising a head support member for supporting rotatably (rockable) a recording head of the full-line type having a length corresponding to the maximum width of the recording medium recordable by the recording apparatus to adjust the paper gap distance by the rotation (rocking movement) of the support member. Such recording head may be either a combination of multiple recording heads to satisfy its length or a single recording head integrally formed.

Further, the present invention is effectively applicable to an arrangement having the recording position and the center of rotation (rocking movement) disposed in order in a conveying direction of the recording sheet to enable the bottom of the recording medium to be detected properly.

What is claimed is:

1. An ink jet recording apparatus which performs recording onto a recording medium using an ink jet recording head, said apparatus comprising:

conveying means for conveying the recording medium to a recording position where the ink jet recording head performs recording;

supporting means for rotatably supporting the ink jet recording head in directions toward and away from the recording medium, said supporting means having a rotational central shaft extending along a direction transverse to a conveying direction of the recording medium;

position detecting means for detecting a position of the recording medium on a conveying passage of the recording medium conveyed by said conveying means;

paper gap adjusting means for adjusting a distance between the recording medium conveyed by said conveying means and the ink jet recording head by actuating said supporting means;

setting means for setting a conveyance amount of the recording medium conveyed beyond the recording position in accordance with the distance between the recording medium and the ink jet recording head adjusted by said paper gap adjusting means; and control means for controlling said conveying means to convey the recording medium by the conveyance amount set by said setting means.

2. An ink jet recording apparatus according to claim 1, wherein an axial center of said rotational central shaft of said supporting means and the recording position are arranged in order from an upstream side in the conveying direction of the recording medium.

3. An ink jet recording apparatus according to claim 2, wherein the ink jet recording head comprises electrothermal elements and performs the recording by applying heat energy generated by the electrothermal elements to ink to create bubbles, which displace and discharge the ink.

4. An ink jet recording apparatus according to claim 1, wherein the recording position and an axial center of said rotational central shaft of said supporting means are arranged in order from an upstream side in the conveying direction of the recording medium.

5. An ink jet recording apparatus according to claim 4, wherein the ink jet recording head comprises electrothermal elements and performs the recording by applying heat energy generated by the electrothermal elements to ink to create bubbles, which displace and discharge the ink.

6. An ink jet recording apparatus according to claim 1, wherein said control means further controls said conveying means to align a top of the recording medium in a direction orthogonal to the conveying direction of the recording medium.

7. An ink jet recording apparatus according to claim 6, wherein the ink jet recording head comprises electrothermal elements and performs the recording by applying heat energy generated by the electrothermal elements to ink to create bubbles, which displace and discharge the ink.

8. An ink jet recording apparatus according to claim 1, wherein the ink jet recording head comprises electrothermal elements and performs the recording by applying heat energy generated by the electrothermal elements to ink to create bubbles, which displace and discharge the ink.

9. An ink jet recording apparatus according to claim 1, wherein said paper gap adjusting means comprises a lever operable by a user.

10. An ink jet recording apparatus according to claim 1, wherein said paper gap adjusting means is controlled by said control means.

11. An ink jet recording apparatus according to claim 1, wherein said position detecting means detects a leading edge of the recording medium and said setting means sets the conveyance amount as an amount the leading edge of the recording medium is to be conveyed beyond the recording position.

12. An ink jet recording apparatus according to claim 1, wherein said paper gap adjusting means has plural discrete settings.

13. An ink jet recording apparatus according to claim 1, wherein said paper gap adjusting means is settable at any setting between upper and lower limits.

14. An ink jet recording apparatus which performs recording onto a recording medium using an ink jet recording head, said apparatus comprising:

conveying means for conveying the recording medium to a recording position where the ink jet recording head performs recording;

supporting means for rotatably supporting the ink jet recording head in directions toward and away from the recording medium, said supporting means comprising a rotational central shaft extending along a direction transverse to a conveying direction of the recording medium;

position detecting means for detecting a position of the recording medium on a conveying passage of the recording medium conveyed by said conveying means;

paper thickness detecting means for detecting a thickness of the recording medium to be conveyed to the recording position;

paper gap adjusting means for adjusting a distance between the recording medium conveyed by said conveying means and the ink jet recording head by actuating said supporting means;

setting means for setting a conveyance amount of the recording medium conveyed beyond the recording position in accordance with a detection result by said paper thickness detecting means; and control means for controlling said conveying means to convey the recording medium by the conveyance amount set by said setting means.

15. An ink jet recording apparatus which performs recording onto a recording medium using an ink jet recording head, said apparatus comprising:

a conveyor roller conveying the recording medium to a recording position where the ink jet recording head performs recording;

a support rotatably supporting the ink jet recording head in directions toward and away from the recording medium, said support comprising a rotational central shaft extending along a direction transverse to a conveying direction of the recording medium;

a position detector detecting a position of the recording medium on a conveying passage of the recording medium conveyed by said conveyor roller;

a paper gap adjusting device adjusting a distance between the recording medium conveyed by said conveyor roller and the ink jet recording head by actuating said support;

a setting device setting a conveyance amount of the recording medium conveyed beyond the recording position in accordance with the distance between the recording medium and the ink jet recording head; and a controller controlling said conveyor roller to convey the recording medium by the conveyance amount set by said setting device.

16. A method for setting a non-recording portion at an end of a recording medium in an ink jet recording apparatus, the ink jet recording apparatus comprising an ink jet recording head and supporting means for supporting the ink jet recording head, the supporting means comprising a rotational central shaft extending along a direction transverse to a conveying direction of the recording medium and rotatably supporting the ink jet recording head in directions toward and away from the recording medium, the ink jet recording head being rotatable to change a distance between the recording medium and the ink jet recording head, said method comprising the steps of:

detecting a position of the recording medium in a conveying passage; and conveying the recording medium beyond a recording position where the ink jet recording head records in accordance with the position of the recording medium detected in said position detecting step and the distance between the recording medium and the ink jet recording head.

17. An ink jet recording apparatus which performs recording onto a recording medium using an ink jet recording head, said apparatus comprising:

conveying means for conveying the recording medium to a recording position where the ink jet recording head performs recording;

position detecting means for detecting a position of the recording medium on a conveying passage of the recording medium conveyed by said conveying means;

head supporting means for supporting the ink jet recording head, said supporting means allowing an ink reaching position of ink on the recording medium, discharged from the ink jet recording head, to be deviated upstream or downstream along a conveying direction of the recording medium;

gap adjusting means for adjusting a distance between the recording medium and the ink jet recording head by actuating said head supporting means, said gap adjusting means deviating the ink reaching position upstream or downstream along the conveying direction of the recording medium by acting on said head supporting means when adjusting the distance;

setting means for setting a conveyance amount of the recording medium to form a non-recording area at a leading end or a rear end of the recording medium in accordance with the distance adjusted by said adjusting means; and control means for controlling said conveying means to convey the recording medium by the conveyance amount set by said setting means.

18. An ink jet recording apparatus according to claim 17, wherein said head supporting means has a rotational central shaft and an axial center of said rotational central shaft and the recording position are arranged in order from an upstream side in the conveying direction of the recording medium.

19. An ink jet recording apparatus according to claim 18, wherein the ink jet recording head comprises electrothermal elements and performs the recording by applying heat energy generated by the electrothermal elements to ink to create bubbles, which displace and discharge the ink.

20. An ink jet recording apparatus according to claim 17, wherein said head supporting means has a rotational central shaft and the recording position and an axial center of said rotational central shaft are arranged in order from an upstream side in the conveying direction of the recording medium.

21. An ink jet recording apparatus according to claim 20, wherein the ink jet recording head comprises electrothermal elements and performs the recording by applying heat energy generated by the electrothermal elements to ink to create bubbles, which displace and discharge the ink.

22. An ink jet recording apparatus according to claim 17, wherein said control means further controls said conveying means to align a top of the recording medium in a direction orthogonal to the conveying direction of the recording medium.

23. An ink jet recording apparatus according to claim 22, wherein the ink jet recording head comprises electrothermal elements and performs the recording by applying heat energy generated by the electrothermal elements to ink to create bubbles, which displace and discharge the ink.

24. An ink jet recording apparatus according to claim 17, wherein the ink jet recording head comprises electrothermal elements and performs the recording by applying heat energy generated by the electrothermal elements to ink to create bubbles, which displace and discharge the ink.

25. An ink jet recording apparatus according to claim 17, wherein said gap adjusting means comprises a lever operable by a user.

26. An ink jet recording apparatus according to claim 17, wherein said gap adjusting means is controlled by said control means.

27. An ink jet recording apparatus according to claim 17, wherein said position detecting means detects the leading end of the recording medium and said control means controls an amount the leading end of the recording medium is to be conveyed beyond the recording position.

28. An ink jet recording apparatus according to claim 17, wherein said gap adjusting means has plural discrete settings.

29. An ink jet recording apparatus according to claim 17, wherein said gap adjusting means is settable at any setting between upper and lower limits.

30. An ink jet recording apparatus which performs recording onto a recording medium using an ink jet recording head, said apparatus comprising:

conveying means for conveying the recording medium to a recording position where the ink jet recording head performs recording;

position detecting means for detecting a position of the recording medium in a conveyance passage of the recording medium conveyed by said conveying means;

head supporting means for supporting the ink jet recording head, said supporting means allowing an ink reaching position of ink on the recording medium, discharged from the ink jet recording head, to be deviated upstream or downstream along a conveying direction of the recording medium;

gap adjusting means for adjusting a distance between the recording medium and the ink jet recording head by actuating said head supporting means, said gap adjusting means deviating the ink reaching position upstream or downstream along the conveying direction of the recording medium by acting on said head supporting means when adjusting the distance;

setting means for setting a conveyance amount of the recording medium in accordance with the distance adjusted by said adjusting means; and control means for controlling said conveying means to convey the recording medium by the conveyance amount set by said setting means, said control means for adjusting the ink reaching position defined when said adjusting means adjusts the distance.

31. An ink jet recording apparatus according to claim 30, wherein said head supporting means has a rotational central shaft and an axial center of said rotational central shaft and the recording position are arranged in order from an upstream side in the conveying direction of the recording medium.

32. An ink jet recording apparatus according to claim 31, wherein the ink jet recording head comprises electrothermal elements and performs the recording by applying heat energy generated by the electrothermal elements to ink to create bubbles, which displace and discharge the ink.

33. An ink jet recording apparatus according to claim 30, wherein said head supporting means has a rotational central shaft and the recording position and an axial center of said rotational central shaft are arranged in order from an upstream side in the conveying direction of the recording medium.

34. An ink jet recording apparatus according to claim 33, wherein the ink jet recording head comprises electrothermal elements and performs the recording by applying heat energy generated by the electrothermal elements to ink to create bubbles, which displace and discharge the ink.

35. An ink jet recording apparatus according to claim 30, wherein said control means further controls said conveying means to align a top of the recording medium in a direction orthogonal to the conveying direction of the recording medium.

36. An ink jet recording apparatus according to claim 35, wherein the ink jet recording head comprises electrothermal elements and performs the recording by applying heat energy generated by the electrothermal elements to ink to create bubbles, which displace and discharge the ink.

37. An ink jet recording apparatus according to claim 30, wherein the ink jet recording head comprises electrothermal elements and performs the recording by applying heat energy generated by the electrothermal elements to ink to create bubbles, which displace and discharge the ink.

38. An ink jet recording apparatus according to claim 30, wherein said gap adjusting means comprises a lever operable by a user.

39. An ink jet recording apparatus according to claim 30, wherein said gap adjusting means is controlled by said control means.

40. An ink jet recording apparatus according to claim 30, wherein said position detecting means detects a leading end of the recording medium and said control means controls an amount the leading end of the recording medium is to be conveyed beyond the recording position.

41. An ink jet recording apparatus according to claim 30, wherein said gap adjusting means has plural discrete settings.

42. An ink jet recording apparatus according to claim 30, wherein said gap adjusting means is settable at any setting between upper and lower limits.

43. An ink jet recording method for performing recording onto a recording medium using an ink jet recording head, said method comprising the steps of:

conveying the recording medium to a recording position where the ink jet recording head performs recording;

detecting a position of the recording medium in a conveyance passage of the recording medium conveyed in said conveying step;

supporting the ink jet recording head with head supporting means that allows an ink reaching position of ink on the recording medium, discharged from the ink jet recording head, to be deviated upstream or downstream along a conveying direction of the recording medium;

adjusting a distance between the recording medium and the ink jet recording head by actuating said head supporting means, said adjusting step deviating the ink reaching position upstream or downstream along the conveying direction of the recording medium by acting on said head supporting means when adjusting the distance;

setting a conveyance amount of the recording medium in accordance with the distance adjusted in said adjusting step; and controlling said conveying step to convey the recording medium by the conveyance amount set in said setting step, said control step adjusting the ink reaching position defined when said adjusting step adjusts the distance.

44. An ink jet recording method according to claim 43, wherein said head supporting means has a rotational central shaft and an axial center of said rotational central shaft and the recording position are arranged in order from an upstream side in the conveying direction of the recording medium.

45. An ink jet recording method according to claim 43, wherein said head supporting means has a rotational central shaft and the recording position and an axial center of said rotational central shaft are arranged in order from an upstream side in the conveying direction of the recording medium.

46. An ink jet recording method according to claim 43, wherein said controlling step further controls said conveying step to align a top of the recording medium in a direction orthogonal to the conveying direction of the recording medium.

47. An ink jet recording method according to claim 43, wherein said adjusting step is effected with a lever operable by a user.

48. An ink jet recording method according to claim 43, wherein said detecting step detects a leading end of the recording medium and said controlling step controls an amount the leading end of the recording medium is to be conveyed beyond the recording position.

* * * * *

UNITED STATES PATENT AND TRADEMARK OFFICE

CERTIFICATE OF CORRECTION

PATENT NO. : 5,975,666

DATED : November 2, 1999

INVENTOR(S) : KOICHIRO KAWAGUCHI

It is certified that error appears in the above-identified patent and that said Letters Patent is hereby corrected as shown below:

COLUMN 3:
Line 10, "the" should read --a--.
Line 13, "reserved unnecessarily widely" should read --made unnecessarily wide--.

COLUMN 6:
Line 51, "the" should read --of the--.

COLUMN 7:
Line 5, "only" should read --by only--.
Line 16, "selected," should read --selected and--.
Line 66, "is" should read --it is--.

COLUMN 8:
Line 1, "of" should read --of the--.
Line 4, "the" (second occurrence) should read --of the--.
Line 17, "And after" should read --After--.

Signed and Sealed this

Tenth Day of October, 2000

*Attest:*

Q. TODD DICKINSON

*Attesting Officer*

*Director of Patents and Trademarks*